US005402135A

United States Patent [19]

DeMarre et al.

[11] Patent Number: 5,402,135

[45] Date of Patent: Mar. 28, 1995

[54] ADJUSTABLE MOBILE ANTENNA MOUNT

[75] Inventors: Allen G. DeMarre, Irving; Clarence D. Zierhut, Richardson, both of Tex.

[73] Assignee: Allen Telecom Group, Inc., Solon, Ohio

[21] Appl. No.: 843,610

[22] Filed: Feb. 28, 1992

[51] Int. Cl.[6] ..... H01Q 1/32; H01Q 1/12

[52] U.S. Cl. ..... 343/715; 343/882; 343/888

[58] Field of Search ..... 343/713, 715, 880, 882, 343/888; H01Q 1/32, 1/08

[56] References Cited

U.S. PATENT DOCUMENTS

| | | | |
|---|---|---|---|
| 4,090,030 | 5/1978 | Lagasse | 174/153 A |
| 4,218,684 | 8/1980 | Northcutt | 343/715 |
| 4,785,305 | 11/1988 | Shyu | 343/715 |
| 4,825,217 | 4/1989 | Choi | 343/715 |
| 4,872,017 | 10/1989 | White | 343/715 |
| 4,893,130 | 1/1990 | Metivier | 343/715 |
| 4,931,806 | 6/1990 | Wunderlich | 343/715 |
| 5,084,947 | 2/1992 | Evans et al. | 24/658 |

FOREIGN PATENT DOCUMENTS

| | | | |
|---|---|---|---|
| 0000204 | 1/1979 | European Pat. Off. | 343/715 |

OTHER PUBLICATIONS

"AS Elevated-Feed-Point Antennas" (undated).
"DBglas Cellular Mobile Antenna" (undated).

*Primary Examiner*—Michael C. Wimer
*Attorney, Agent, or Firm*—Laff, Whitesel, Conte & Saret, Ltd.

[57] ABSTRACT

A mobile communication antenna adjustably mounted to a base at desired angular orientations. A decorative cover snap locks to the base to cover the antenna base structure. The cover includes a small opening through which a portion of an articulating arm extends to provide a wide range of angle adjustments of the antenna within the opening in the cover. The articulating arm provides an offset between the antenna axis and the axis of pivotal movement.

5 Claims, 3 Drawing Sheets

FIG. 2
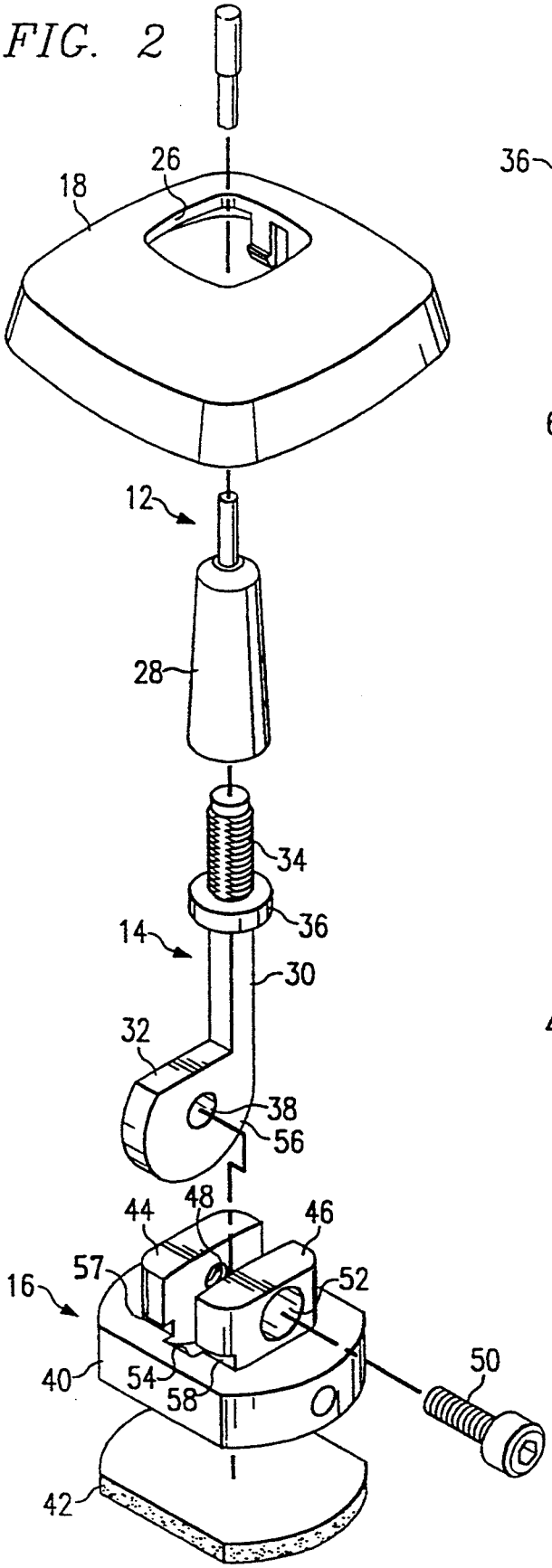
FIG. 3a
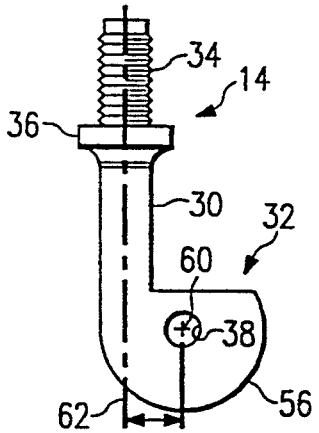
FIG. 3b
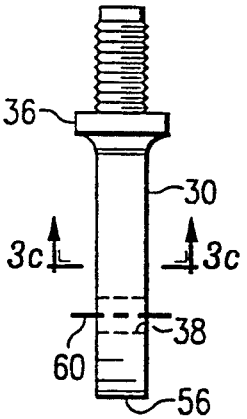
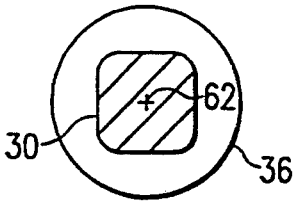
FIG. 3c
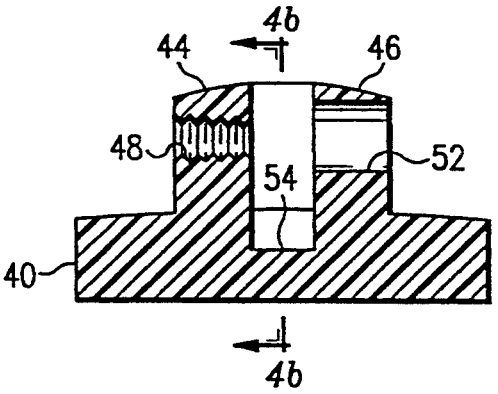
FIG. 4a
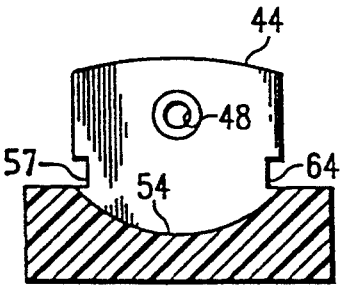
FIG. 4b

ADJUSTABLE MOBILE ANTENNA MOUNT

TECHNICAL FIELD OF THE INVENTION

The present invention relates in general to antennas for mobile communications equipment, and more particularly to cellular communication antennas of the type mounted to vehicle windows.

BACKGROUND OF THE INVENTION

The development and commercialization of mobile communication equipment, including mobile radios and mobile telephones, have allowed communications between fixed base transmitters and receivers and mobile communication facilities installed in vehicles. As a result, the field of mobile communication has expanded substantially.

Mobile communication channels have been set aside in the 800–900 MHz range, as contrasted with the heretofore popular citizens band communications which operate in the 28–39 MHz range. Because of the higher operating frequencies of mobile communication transceivers, the antennas are much shorter in length and can be easily mounted on the vehicle. Indeed, a popular technique for mounting mobile communications antennas is by mounting such antennas on the rear window of the vehicle, and transmitting and receiving the RF energy via a capacitive effect through the window, to the antenna. As is well known, mobile communication antennas operate with transceivers which are capable of the transmission and reception of RF signals using different frequencies, but using the same antenna. Glass-mounted mobile communication antennas of such type are illustrated in U.S. Pat. Nos. 4,266,227; 4,474,353 and 4,839,660.

While the length of mobile cellular communication antennas are relatively short, being about 16 inches in length, making such antennas relatively easy to mount to a vehicle, the high frequency operation imposes other and more critical constraints. For example, in order to provide an omnidirectional electromagnetic pattern of radiation and reception, the mobile communication antennas operate optimally when in a vertical orientation. While this in and of itself does not present a substantial impediment to the design of an economical antenna mount, yet other concerns tend to complicate the design considerations. For instance, the desired location for mounting a mobile communication antenna is to the back window of the vehicle. This places the antenna in a location most removed from the vehicle occupants, on a window that is not movable itself, and out of the line of sight of the vehicle driver. However, because most vehicle models have a different type of rear window design, having a slant from near vertical to 45% or so, a problem arises as to the mounting thereof in a vertical orientation. Accordingly, either many different types of mobile antenna mounts are required, or an adjustable mount is required in order to mount a vertically oriented antenna on the many different types and styles of vehicle windows. U.S. Pat. No. 4,839,660 identified above provides a rigid antenna mount which is effective on a narrow range of rear window slants in order to orient the antenna vertically. On the other hand, U.S. Pat. No. 4,266,227 discloses a window-mounted antenna that is adjustable to accommodate numerous types of windows, and therefore appears to be more universal in use.

While the adjustable antenna mounts identified above appear to be useful for their intended purpose, they are not aesthetically pleasing as substantially all the mounting apparatus and hardware is exposed and thus is visible. While various antenna base hoods and covers might be utilized, such covers would impair the adjustability of the antennas with respect to the mounting bases, or would be unduly complex and thus cost prohibitive. Further, in order to provide a full cover for the antenna mounting base, the cover must be removable to allow the antenna to be adjusted and then fixed to the base, and thus not interfere with such adjustments. Of course, other holes could be provided in a cover to allow screwdrivers or wrenches access to the internal adjusting apparatus, but such a construction would present a compromise in an otherwise aesthetically pleasing smooth and contoured cover.

From the foregoing, it can be seen that a need exists for an antenna having a wide range of adjustments while yet affording an aesthetically pleasing and decorative cover to hide the entire mounting base and adjustment mechanism. Another need exists for a cover with a single opening therein through which the antenna extends, which is snap fittable to the antenna mounting base, and which can be easily installed after final adjustment of the antenna. Another need exists for an antenna mount, and a cover, and an adjustment means for allowing the antenna to be oriented in a position substantially parallel to the surface plane to which the antenna is mounted, while yet utilizing only a relatively small opening in the decorative cover.

SUMMARY OF THE INVENTION

In accordance with the invention, there are disclosed herein techniques and apparatus for providing a mobile communication antenna mount which eliminates or substantially reduces the disadvantages inherent in the prior art structures and techniques.

In accordance with an important feature of the invention, the antenna mounting apparatus includes an articulation arm to which the antenna whip is mounted. The arm has an exposed section and an offset hidden section with a bore for pivotal or adjustable mounting to an antenna base member. A cover providing protection and a decorative appearance includes a single small opening through which the exposed section of the articulation arm extends for allowing a wide range of adjustments to the whip antenna. In addition, the cover snap fits to the mounting base to provide an economical and aesthetically pleasing appearance to the entire antenna assembly.

In accordance with the preferred embodiment of the invention, the antenna base member includes a flat bottom surface for adhering the entire antenna assembly to a window or other surface of the vehicle. The base member includes a tab or surface extending therefrom to which the articulating arm is movably adjusted and attached by a threaded fastener. The base member includes an additional tab through which the threaded fastener freely passes but otherwise is not essential for mounting the articulating arm, and thus the whip antenna, to the base member. A cover, formed of a moldable plastic, includes side walls surrounding the antenna base, and a tapered or domed top extending from the side walls toward a central opening, through which the articulating arm extends. Because the articulating arm is mounted for pivotal movement to the base member about an axis that is offset from the axial axis of both the antenna and the exposed portion of the articulating arm, a large angle of movement of the antenna within the cover opening is possible without providing a large slot in the cover.

The decorative cover, when pressed onto the base member, is automatically registered therewith and snap fitted thereto. The exterior, or exposed surface of the cover is otherwise smooth and not interrupted by adjusting holes, except for the single small opening through which the exposed section of the articulating arm extends. Further, formed internal to the cover, and integral therewith are a number of lateral registration skirting members for receiving therein the base member. The spaced apart tabs extending from the antenna base member fit and are registered within the edge of the single opening of the cover, thereby facilitating registration of the parts together. The cover also has formed on internal surfaces thereof hook members which engage with corresponding indentions formed in the base member for providing a snap locking engagement therebetween. Stop tabs formed on the inner surface of the decorative cover engage the antenna base member when snap fitted thereto, thus locking the parts together. Accordingly, when the cover is pressed onto the base member, the parts automatically become registered and snap locked together.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements throughout the views, and in which:

FIG. 2 is an isometric view of the various parts of the antenna assembly of the invention, shown with the parts thereof removed from each other;

FIG. 3*a*–3*c* illustrate various views of the articulating arm having an exposed section thereof to which the whip is attached, and a hidden section for mounting to the base member;

FIGS. 4*a*–4*d* illustrate various views of the antenna base member;

DETAILED DESCRIPTION OF THE INVENTION

Figure 1:
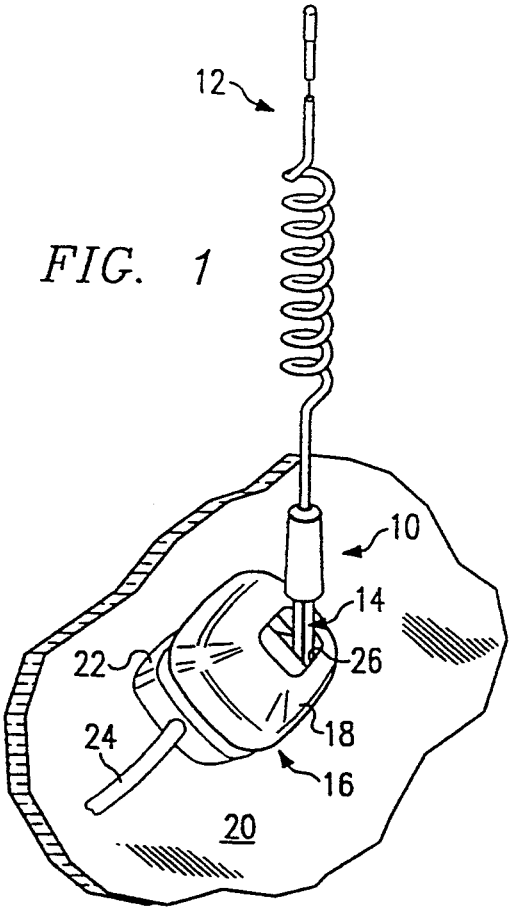
FIG. 1 illustrates the antenna assembly according to the preferred embodiment of the invention, as mounted to a vehicle window.

With reference to FIG. 1, there is illustrated a one of the many applications in which the antenna assembly of the invention can be advantageously practiced. The antenna assembly 10 includes a whip 12 removably attached to an articulating arm 14 which, in turn, is electrically connected to a base 16, shown hidden and protected by a decorative cover 18. The antenna base 16 is mounted to a vehicle window 20 by a suitable adhesive, and is capacitively coupled to an antenna matching assembly 22 that provides an impedance match and electrical coupling circuits for coupling RF energy from a coaxial cable 24 through the glass 20 to the antenna assembly 10. While the whip 12 is shown with a matching coil, many other types of antennas can be utilized with equal effectiveness.

It is noted from FIG. 1 that the decorative cover 18 includes a small opening 26 therein for allowing a wide range of adjustments of the whip 12 to maintain a vertical orientation with a variety of different styles of vehicle windows having different angles of slants. As will be described in more detail below, the mounting base 16 of the antenna assembly 10 can be fixed to the vehicle glass 20 with the decorative cover 18 removed, the antenna whip 12 can be adjusted vertically by properly adjusting the articulating arm 14 and fixing the arm to the mounting base, and thereafter the decorative cover 18 can be installed over the whip 12 and snap fitted to the mounting base 16. As will be described more fully below, the cover 18 can be removed for maintenance of the antenna assembly 10 or readjustment of the orientation of the whip 12.

The antenna assembly 10 of the invention is shown in more detail in FIG. 2, with the parts thereof removed from each other. The whip 12 is constructed of a 302 stainless steel wire of length appropriate for operating at a desired frequency. The bottom end of the whip 12 is press fit into a brass ferrule 28. While not shown, the bottom end of the ferrule 28 has a threaded bore for threadable securement to the exposed section of the articulation arm 14. The arm 14 includes an exposed upper section 30 and a hidden lower section 32. The exposed arm section 30 has a threaded end 34 that is threadably fastened to the brass ferrule 28 and provides an electrical connection thereto. The exposed section 30 of the arm 14 includes an annular shoulder 36 against which the end of the ferrule 28 abuts when tightened. Although a portion of the exposed section 30 of the articulating arm 14 is cross-sectionally square, such a shape is not required. The exposed arm section 30 is formed integral with the hidden section 32 in such a manner as affording an offset between the axial axis of the whip 12 that extends through the exposed portion 30 of the articulating arm, and an orthogonal axis which extends through a bore 38 formed through the hidden section 32 of the arm 14. Preferably, the articulating arm 14 is fabricated of an electrically conductive material, such as cast zinc. Essentially, the hidden section 32 of the arm extends perpendicularly to the exposed section 30 so that the axes noted above are spaced apart. It should be noted that the whip 12 and the articulating arm 14 are adjustably pivoted about the offset bore 38, thereby allowing the exposed section 30 to move with respect to the opening 26 in the decorative cover 18 and realize a wide angle of adjustments thereof while yet maintaining the opening 26 in the cover 18 relatively small. As noted above, the offset nature of the articulating arm 14 eliminates the need of an elongate slot-type cover opening, which otherwise would be required in the adjustable antennas identified in the patents above. Preferably, the offset bore 38 is not painted or coated with an insulating material, thereby providing electrical continuity throughout the various parts of the antenna assembly 10. The .articulating arm 14, the ferrule 28 and the whip 12 are shown as separate elements, although combinations thereof could be formed as two units or as a single unitary unit.

Further illustrated in FIG. 2 is the antenna base 16, also formed with a conductive material such as cast zinc. The base 16 includes a base member 40 formed essentially as a circle with opposing sides cut in a parallel manner. The shorter width of the base member 40 is of such a dimension for allowing the base 16 to be situated between defrosting conductors of the type typically formed in the rear windows of automobiles. A double sided adhesive 42, also of the same shape as the base member 40 is fastened to the bottom side thereof. A peel-type, very high binding adhesive tape provides a high quality bonding of the base member 40 to glass surfaces. While not shown, the under surface of the base member 40 can be contoured to provide a shape complementary to the surface shapes to which the antenna assembly 10 is to be mounted.

The base member includes a first tab 44, and a second tab 46 spaced apart from the first tab, each extending generally perpendicular from the base member 40. The tabs 44 and 46 are spaced apart sufficiently to receive therebetween the hidden section 32 of the articulating arm 14. The first tab 44 includes a threaded bore 48 for threadable engagement with an allen screw 50. It should be noted that the diameter of the offset bore 38 in the articulating arm 14 is of a size so that the threaded shank portion of the allen screw 50 passes freely therethrough. The second tab 46 of the base 16 includes a bore 52 for loosely receiving the head of the allen screw 50. The second tab 46 provides no function in the securement of the articulating arm 14 to the first tab 44, but rather functions with the first tab 44 in providing registration, with an edge of the opening 26 of the decorative cover 18. As noted, the general exterior shape or outline of the tabs 44 and 46 is complementary to the shape of the decorative cover opening 26 for snug fitting therein when the cover is snap fitted to the base 16.

As further noted in FIG. 2, the base member 40 includes a concave depression 54 in which a correspondingly-shaped convex edge 56 of the articulating arm moves, thereby providing a low profile mounting base.

Each of the mounting base tabs 44 and 46 includes a notch or indentation 57 and 58 on opposing sides, only one such notch of each tab being shown in FIG. 2. The notches 57 and 58 are engageable with hook members formed on the inside of the decorative cover 18 for snap fitting the cover to the base 16.

FIGS. 3*a*–3*c* illustrate the details of the construction of articulating arm 14. FIG. 3*a* is a side plan view thereof showing the offset bore 38 formed about an axis 60 that is orthogonal to an axial axis 62 that extends through the exposed section 30 of the arm 14. Further, the orthogonal axes 60 and 62 are spaced apart to provide the range of movements illustrated in FIG. 7. In the preferred form of the invention, the noted axes are spaced apart about 0.210 inches. Essentially, the exposed arm section 30 moves about the axis 60 in an eccentric manner, and into and out of the opening 26 of the decorative cover 18 without requiring a large opening. Also noted in FIG. 3*a*, a lower edge of the hidden arm section 32 is rounded so as not to engage the arcuate depression 54 formed in the base member 40. Those skilled in the art may find it advantageous to form ridges appropriately spaced on the bottom edge 56 of the hidden arm section 32 for engagement with base member 40 at the ends of the pivotal range, thereby providing stops and preventing pivotal movement of the articulating arm 14 beyond a prescribed range.

Figure 4C:
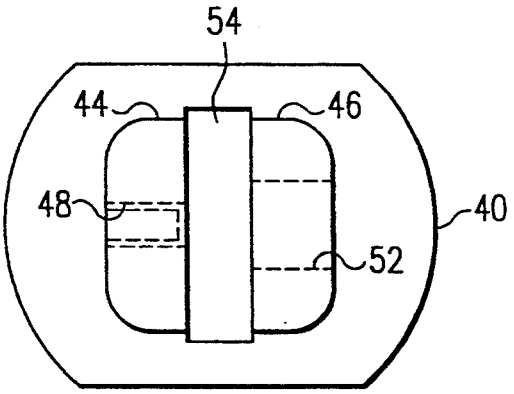
Figure 4D:
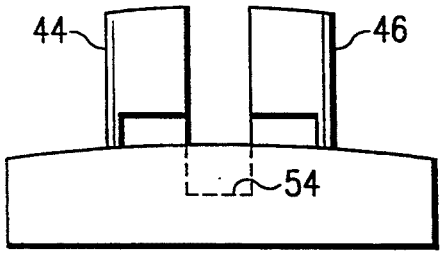

FIGS. 4*a*–4*d* illustrate different views of the antenna base 16 according to the invention. Particularly, FIG. 4*a* illustrates the threaded bore 48 in the tab 44, as well as the larger, nonthreaded bore 52 in the second tab 46. The top ends of the tabs 44 and 46 are slightly contoured to conform to the curvature of the top of the decorative cover 18, thereby providing a more aesthetically pleasing appearance. The arcuate depression 54 that accommodates the bottom, curved edge 56 of the articulating arm 14 is shown in more detail in FIG. 4*b*. The slight contour of the top surface of the first tab 44 is also illustrated. The opposing notches 57 and 64 are shown formed into the opposing sides of the first tab 44 for engagement with corresponding hook members of the decorative cover 18. Similar notches are formed in the opposing sides of the second tab 46.

Figure 5A:
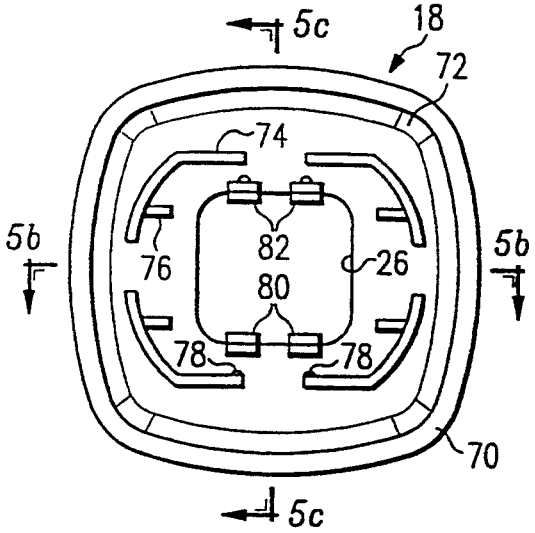
FIGS. 5*a*–5*c* illustrate respectively a bottom view of the decorative cover, as well as two sectional views.
Figure 5B:
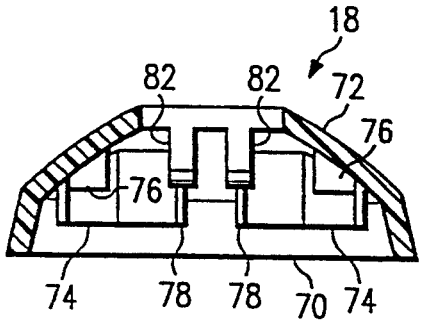
Figure 5C:
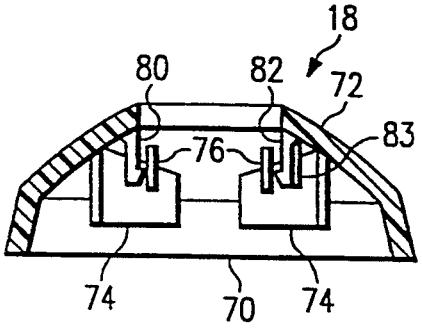

FIGS. 5*a*–5*c* illustrate the detailed construction of the decorative cover 18. The decorative cover 18 is generally of a dome shape, formed of an ABS plastic of the type GSM-4500. FIG. 5*a* depicts the construction of the decorative cover 18, as viewed from the underside thereof. The cover 18 includes a bottom edge 70 with a circumferential shape that is generally square with rounded corners. The cover opening 26 is of a similar shape. The bottom edge 70 of the cover 18 can be any general shape, and is not limited to that shown in the figures.

Injection molding techniques are suitable for fabricating the decorative cover 18 of the invention. Molded internal to the cover 18 and integral to the dome portion 72 thereof is a registration skirt, formed as four separate skirts, one shown as reference number 74. The registration skirts 74 are shaped in a manner similar to the circumferential shape of the base member 40. In this manner, when the decorative cover 18 is pushed onto the antenna base 16 and snap locked thereto, the registration skirting members 74 receive and envelop the base member 40 to register the antenna base 16 with respect to the decorative cover 18. Two of the skirting members 74 have formed thereon ribs 78 for providing a tight fit of the cover 18 to the base member 40. Rattling or vibration between the cover 18 and the base member 40 is thus minimized. Further registration of the parts is achieved by the cover opening 26 which is also shaped to receive and surround three sides each of the ends of the base tabs 44 and 46, as shown in FIG. 1. Each of the registration skirting members 74 is shown in FIGS. 5*b* and 5*c*. Moreover, formed integral with the dome portion 72 of the cover 18 and integral to a portion of the skirting side wall are four stop tabs, one shown as reference numeral 76. As can be seen, the bottom surface of the stop tabs 76 are recessed vertically from the marginal edge 70 of the cover an amount equal to the vertical thickness of the base member 40. Thus, when the decorative cover 18 is snap fit onto the antenna base 16, an upper surface of the base member 40 abuts with a lower edge of the stop tabs 76, whereby the base member 40 is both registered in a vertical and lateral manner with respect to the cover 18.

FIGS. 5*b* and 5*c* illustrate that the dome portion 72 of the decorative cover 18 is not rounded, but rather is formed with smoothly contoured and somewhat planar surfaces. Again, the shape and contour of the exterior surface of the decorative cover 18 is generally arbitrary and is chosen for aesthetic or decorative purposes. Two of the skirting members 74 have formed thereon ribs 78 at the edges thereof, the purpose of which will be described in more detail below.

Figure 6A:
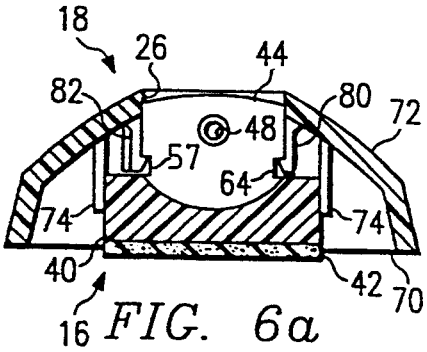
FIGS. 6*a* and 6*b* illustrate sectional views of the decorative cover as snap fitted to the antenna base member.

The decorative cover 18 further includes two downwardly, depending hook members 80 and oppositely located hook member pairs 82. The hook members are formed integral with the cover dome 72, adjacent the edge of the opening 26. The function of the hook members 80 and 82 is shown in more detail in FIG. 6*a*, where the cover 18 is shown snap locked to the antenna base 16. The hook members 82 have reinforcing ribs 83 formed thereon to make such members more rigid and less likely to break when snapped onto the base member 40. Particularly, a hooked end of the member 82 is shown engaged in the slot 56 of the antenna base. In like manner, the hooked end of the member 80 is shown engaged in the slot 64, also formed in the antenna base 16. As can be appreciated, the registration skirts 74 are shown engaged with the vertical sides of the base member 40. Also shown for facilitating engagement and registration between the antenna parts is the upper end of the tab 44 that engages the edge of the cover opening 26.

Figure 6B:
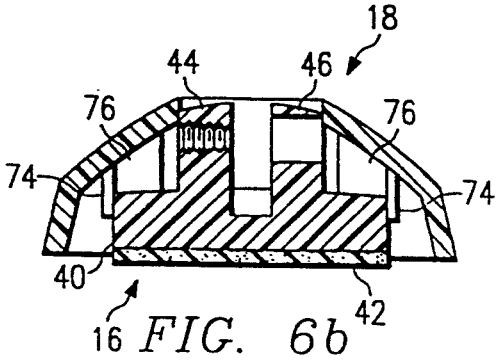

FIG. 6*b* is a different cross-sectional view of the engaging relationship between the cover 18 and the antenna base 16. In this cross-sectional view, it can be seen that the lower edges of the cover stop tabs 76 engage the upper surface of the base member 40 so that when snap locked, the base member is effectively captured by the stop tabs 76 and by the hook members 80 and 82. More particularly, the stop tabs 76 prevent the cover 18 from being further pushed onto the antenna base 16, whereas the hook members 80 and 82 prevent inadvertent release of the cover 18 from the antenna base 16. It should be appreciated that because the hooked ends of the members 80 and 82 are connected to the cover 18 by elongate arms, a degree of lateral flexibility is provided. Hence, when a sufficient pulling force is exerted on the decorative cover 18 the hook members 80 and 82 are forced outwardly, thereby releasing the cover from the antenna base 16.

Preferably, the metal parts of the antenna assembly 10 are painted or otherwise coated with a material to provide protection from corrosion. Of course, the areas of the antenna that constitute electrical contact areas are not coated which otherwise would insulate the parts. The color of the antenna metal parts is preferably the same as the decorative cover 18.

Figure 7:
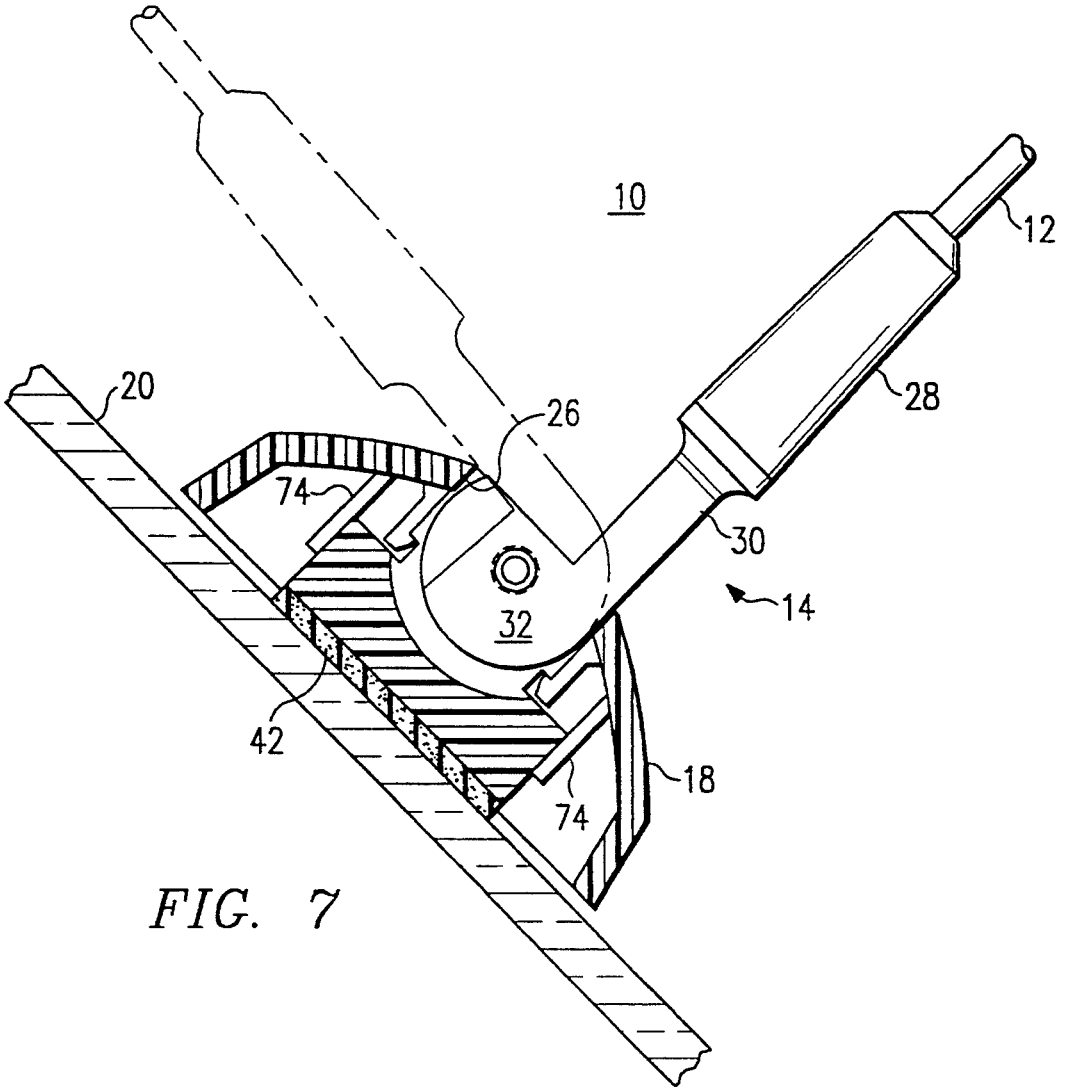
FIG. 7 illustrates a sectional view of the antenna assembly, showing different adjustable positions of the antenna whip with respect to the window to which the antenna assembly is fixed.

With reference now to FIG. 7, there is shown a partial cross-sectional view of the antenna assembly of the invention, without the associated capacitive coupling apparatus fixed to the inside of the vehicle window 20. As noted in FIG. 7, the layer of adhesive 42 permanently bonds the antenna assembly 10 to the surface of an object, shown as a vehicle window 20. Importantly, the decorative cover 18 encloses the structure and hardware of the antenna base 16, except for the exposed end surfaces of each of the base tabs 44 and 46. However, in this instance the ends of the base tab surfaces are smooth and contoured with the exterior surface of the cover 18. It is contemplated that the opening 26 in the cover 18 could be even smaller, if the base tabs 44 and 46 did not extend into the opening 26, but rather were engaged with other skirting members (not shown) for use in the cover adjacent the opening. As can be appreciated, a majority of the articulating leg 14 is covered, including its pivotal connection to the antenna base 16. The exposed section 30 of the articulating arm 14 projects through the cover opening 26 and allows the whip 12 to be oriented at an angle substantially perpendicular to the mounting surface 20, as shown in solid line of FIG. 7. In addition, the whip 12 can be adjusted to a position where it is substantially parallel to the mounting surface 20, as shown in broken line. The antenna whip can be adjustably fixed in angular orientations in the range of about 120°. The whip 12 can be adjusted to any intermediate angle within this range to accommodate different slant angles of the surface to which the assembly may be mounted so that the whip 12 itself remains in a vertical and upright orientation. It can be appreciated that were it not for the offset between the antenna axis and the axis of pivotal movement, a substantially larger opening would be required in the cover in order to provide a similar range of pivotal adjustability.

From the foregoing, disclosed is an antenna mount that provides a large range of angles of adjustment, while yet utilizing a decorative cover of a relatively small opening therein. The decorative cover is preferably injection molded, and thus is cost effective, allows the antenna angle to be fixed in a position and thereafter the cover can be snap fit to the antenna base. A low-profile base mount is thus realized and is aesthetically pleasing, in that a major portion of the antenna mounting apparatus is covered by the cover.

While the preferred embodiment of the invention has been disclosed with reference to a specific antenna mounting structure and technique, it is to be understood that many changes in detail may be made as a matter of engineering choices, without departing from the spirit and scope of the invention, as defined by the appended claims.

What is claimed is:

1. Apparatus for mounting an antenna to a surface of an object, comprising:

an articulating arm and an elongated whip attached thereto, said whip defining an axial axis;

a base adapted for fixing to said surface, said base having means for mounting thereto said articulating arm, said articulating arm including a section defining an offset bore, said bore being offset from the axial axis of said whip, said articulating arm and said whip being pivotally moveable about said bore on said base, so that said whip can be fixed at a desired position with respect to said base; and a protective cover attached to said base for covering the base so that said base is hidden from view, said cover having an opening only in a top portion thereof through which at least a portion of said articulating arm extends, whereby said articulating arm and thus said whip can be pivoted from a first position in which said whip is substantially perpendicular to the surface of the object to a second position in which said whip is substantially parallel to said object surface, and;

wherein said cover has hook members and said base has notches for engagement therewith for snap locking together.

2. The antenna apparatus of claim 1, wherein said cover includes a stop tab engaged with said base and operating with said hook members for snap locking the cover to the base.

3. Apparatus for mounting an antenna in one of numerous positions with respect to an object surface to which said antenna is to be mounted comprising:

a whip defining said antenna;

a base structure having a flat surface for mounting to said object surface, said base structure having a tab extending from said base structure, said tab having a threaded hole, and said tab having one or more indentions in a surface thereof;

an articulating arm having a threaded end for fixing thereto said whip, said threaded end having an axis extending axially through said whip, and said articulating arm having a hidden end having a hole therein with an axial axis that is offset from the axis of said whip;

a threaded fastener for passing through the hole in said articulating arm and threadably cooperating with the threaded hole in said tab for fixing said articulating arm and thus said whip at a desired angle with respect to said object surface;

a cover having an aperture in a top surface thereof through which the articulating arm is pivotal at least 60 degrees, said cover externally covering said base structure and said hidden end of said articulating arm, and having means for engaging said indentions in said tab for snap fitting thereto; and said articulating arm having an offset part for providing said offset, and wherein said offset part remains substantially protected by said cover irrespective of a pivotal position thereof, and wherein said tab defines a first tab, and wherein said base structure includes a second tab spaced apart from said first tab for receiving therebetween the hidden end of the articulating arm.

4. Apparatus for mounting an antenna in one of numerous positions with respect to an object surface to which said antenna is to be mounted, comprising:

a whip defining said antenna;

a base structure having a flat surface for mounting to said object surface, said base structure having a tab extending from said base structure, said tab having a threaded hole, and said tab having one or more indentions in a surface thereof;

an articulating arm having a threaded end for fixing thereto said whip, said threaded end having an axis extending axially through said whip, and said articulating arm having a hidden end having a hole therein with an axial axis that is offset from the axis of said whip;

a threaded fastener for passing through the hole in said articulating arm and threadably cooperating with the threaded hole in said tab for fixing said articulating arm and thus said whip at a desired angle with respect to said object surface;

a cover having an aperture in a top surface thereof through which the articulating arm is pivotal at least 60 degrees, said cover externally covering said base structure and said hidden end of said articulating arm, and having means for engaging said indentions in said tab for snap fitting thereto; and said articulating arm having an offset part for providing said offset, and wherein said offset part remains substantially protected by said cover irrespective of a pivotal position thereof, and wherein said cover covers said base structure, said cover having formed on an inner surface thereof registration means protruding from a surface of the cover for providing lateral registration of said base therein, and stop tabs for engagement with said base structure.

5. Apparatus for mounting an antenna in one of numerous positions with respect to an object surface to which said antenna is to be mounted, comprising:

a whip defining said antenna;

a base structure having a flat surface for mounting to said object surface, said base structure having a tab extending from said base structure, said tab having a threaded hole, and said tab having one or more indentions in a surface thereof;

an articulating arm having a threaded end for fixing thereto said whip, said threaded end having an axis extending axially through said whip, and said articulating arm having a hidden end having a hole therein with an axial axis that is offset from the axis of said whip;

a threaded fastener for passing through the hole in said articulating arm and threadably cooperating with the threaded hole in said tab for fixing said articulating arm and thus said whip at a desired angle with respect to said object surface;

a cover having an aperture in a top surface thereof through which the articulating arm is pivotal at least 60 degrees, said cover externally covering said base structure and said hidden end of said articulating arm, and having means for engaging said indentions in said tab for snap fitting thereto; and said articulating arm having an offset part for providing said offset, and wherein said offset part remains substantially protected by said cover irrespective of a pivotal position thereof, and wherein said cover includes a single hole therein through which said threaded end of said articulating arm extends.

* * * * *